US005300410A

United States Patent [19]

Date et al.

[11] Patent Number: 5,300,410

[45] Date of Patent: Apr. 5, 1994

[54] DEVELOPER FOR SILVER HALIDE PHOTOGRAPHIC LIGHT-SENSITIVE MATERIAL

[75] Inventors: Sukeaki Date; Eiichi Terashima; Toshiro Kondo; Eiji Matsubara; Masao Okushima; Seiichi Sumi, all of Nagaokakyo, Japan

[73] Assignee: Mitsubishi Paper Mills Limited, Tokyo, Japan

[21] Appl. No.: 20,458

[22] Filed: Feb. 22, 1993

Related U.S. Application Data

[63] Continuation of Ser. No. 798,995, Dec. 2, 1991, abandoned, which is a continuation of Ser. No. 554,523, Jul. 20, 1990, abandoned.

[30] Foreign Application Priority Data

Jul. 21, 1989 [JP] Japan ..... 1-186265
Mar. 30, 1990 [JP] Japan ..... 2-083106

[51] Int. Cl.[5] ..... G03C 5/305
[52] U.S. Cl. ..... 430/488; 430/446; 430/490
[58] Field of Search ..... 430/434, 440, 442, 445, 430/446, 488, 489, 490

[56] References Cited

U.S. PATENT DOCUMENTS 4,443,531 4/1984 Yamada et al. ..... 430/331

*Primary Examiner*—Hoa Van Le
*Attorney, Agent, or Firm*—Cushman, Darby & Cushman

[57] ABSTRACT

Disclosed is a developer for silver halide photographic light-sensitive material which contains at least one of the compounds represented by the following formulas [I], [II] and [III]:

Formula [I]:

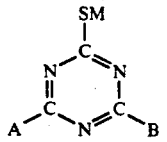

[I]

wherein M represents a hydrogen atom, an alkali metal or $NH_4$ and A and B each represents a mercapto group, a hydroxyl group, a hydroxyalkyl group, or

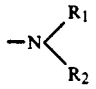

wherein $R_1$ and $R_2$ each represents a hydrogen atom or —X—Y group in which X represents a divalent group and Y represents a carboxyl group or a hydroxyl group, Formula [II]:

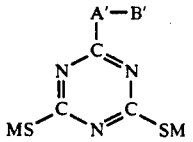

[II]

wherein M represents a hydrogen atom, an alkali metal or $NH_4$, A′ represents an organic divalent group, and B′ represents $—SO_3M'$, —COOM′, $—SO_2NHR_3$, $—CONHR_3$, or —OH wherein M′ represents a hydrogen atom, an alkali metal atom or $NH_4$, and $R_3$ represents a hydrogen atom or an alkyl group of 1–3 carbon atoms, and Formula [III]:

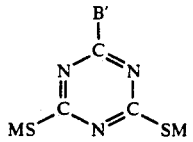

[III]

wherein M and B′ are the same as defined in the above formula [II]:

8 Claims, No Drawings

DEVELOPER FOR SILVER HALIDE PHOTOGRAPHIC LIGHT-SENSITIVE MATERIAL

This is a continuation of application Ser. No. 07/798,995, filed on Dec. 2, 1991, now abandoned, which was a continuation of Ser. No. 07/554,523, filed Jul. 20, 1990, now abandoned.

BACKGROUND OF THE INVENTION

The present invention relates to a method for development of silver halide photographic light-sensitive materials and particularly to a developer used therefor.

In general, it is known that developer used for development of silver halide photographic light-sensitive materials contains a sulfate for increasing storage stability of the developer. In some case, there are used developers which contain a compound such as a thiosulfate having strong dissolving action on silver halide such as developers for silver complex diffusion transfer process and combined developing and fixing baths.

When light-sensitive materials are treated with developer containing compound having dissolving action on silver halide such as sulfate or thiosulfate, a large amount of silver complex dissolves into the developer and this silver complex is readily reduced and accumulated as silver sludge. Especially when light-sensitive material is continuously treated by automatic processor, not only the silver sludge floats, but also it sticks to roller or belt to result in stains on the light-sensitive material due to the precipitated silver which are called silver stains in the form of streaks of rollers and which appear yellow or brown upon reflection of light.

As inhibitors for formation of silver sludge and contamination of developer, there are known 2-mercapto-1,3,4-thiadiazoles (British Patent No. 940169), 2-mercapto-1,3,4-oxadiazoles or 1-phenyl-5-mercaptoterazoles (U.S Pat. No. 3,173,789), D.L.-6,8-dithiooctanoic acid (U.S. Pat. No. 3,318,701), o-mercaptobenzoic acid (British Patent No. 1144481), aliphatic mercaptocarboxylic acids (U.S. Pat. No. 3,628,955), L-thiazolidine-4-carboxylic acids [J. Photogr. Sci., 13, 233 (1965)], disulfide compounds [Japanese Patent Kokai (Laid-Open) No. 52-36029], 2-benzoxazole thiol, 2-benzimidazole thiol [Photgr. Sci. Eng., 20, 220 (1976)], acetylene glycols [Japanese Patent Kokai (Laid-Open) No. 55-95947], and 2-mercaptobenzothiazole-5-sulfonic acid [Japanese Patent Kokai (Laid-Open) No. 56-72441].

However, when these compounds are used in developers having dissolving action on silver halide, especially developers containing a sulfate in high concentration (e.g., 0.2 mol/1 or more) as sludge inhibitor, there are the problems that they lose sludge inhibiting effect or are weak in sludge inhibiting effect and must be used in a large amount, they have adverse effect on photographic characteristics such as reduction in sensitivity, low contrast and retardation in development, and besides they are expensive or have an offensive odor.

SUMMARY OF THE INVENTION

Accordingly, an object of the present invention is to provide a developer which can inhibit contamination thereof or contamination of roller and belt of automatic processor by silver sludge and can afford photographic images free from silver stain and excellent in finished quality when the developer has dissolving action on silver halide, especially when it is a stable developer containing sulfate in a high concentration and when this is used for treatment of light-sensitive materials in automatic processor.

Another object of the present invention is to provide a method for treating silver halide black-and-white photographic light-sensitive materials with the developer which is free from the above problems and is inhibited from generation of silver sludge.

The above objects of the present invention has been attained by containing at least one of the compounds represented by the following formulas [I], [II]and [III]in developer for silver halide photographic light-sensitive materials.

Formula [I]:

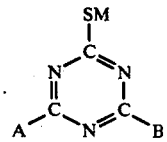

[I]

(wherein M represents a hydrogen atom, an alkali metal or $NH_4$ and A and B each represents a mercapto group, a hydroxyl group, a hydroxyalkyl group, or

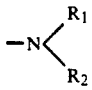

wherein $R_1$ and $R_2$ each represents a hydrogen atom or —X—Y group in which X represents a divalent group and Y represents a carboxyl group or a hydroxyl group).

Formula [II]:

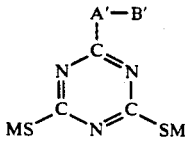

[II]

(wherein M represents a hydrogen atom, an alkali metal or $NH_4$, A′ represents an organic divalent group, and B′ represents $—SO_3M'$, —COOM′, $—SO_2NHR_3$, $—CONHR_3$, or —OH wherein M′ represents a hydrogen atom, an alkali metal atom or $NH_4$, and $R_3$ represents a hydrogen atom or an alkyl group of 1–3 carbon atoms).

Formula [III]:

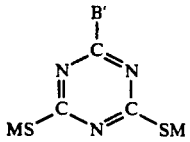

[III]

(wherein M and B′ are the same as defined in the above formual [II])

Typical examples of the compounds represented by the above formulas [I], [II] and [III] are enumerated below only by showing A, B, A′, and B′ in the formulas.

| Compounds of formula [I]: | | |
|---|---|---|
| Compound No. | —A | —B |
| (1) | —SH | —SH |
| (2) | —SH | —OH |
| (3) | —SH | —$NH_2$ |
| (4) | —OH | —OH |
| (5) | —SH | —$C_2H_4OH$ |
| (6) | —SH | —$NHCH_2COOH$ |
| (7) | —$NHCH_2COOH$ | —$NHCH_2COOH$ |
| (8) | —SH | —$NHC_2H_4OH$ |
| (9) | —$NHC_2H_4OH$ | —$NHC_2H_4OH$ |
| (10) | —SH | 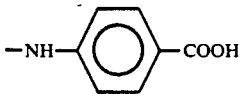 |

| Compounds of formulas [II] and [III]: | | |
|---|---|---|
| Compound No. | —A' | —B' |
| (11) | —$NHCH_2CH_2$— | —$SO_3H$ |
| (12) | 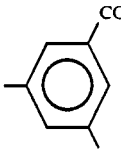 | —$SO_3H$ |
| (13) | —$CH_2CH(OH)CH_2$ | —COOH |
| (14) | 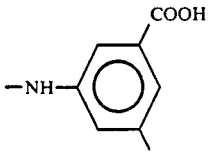 | —COOH |
| (15) | —NH$\leftarrow$CH(OH)$\rightarrow_4$ $CH_2$— | —OH |
| (16) | —$NHCOCH_2CH_2$— | —COOH |
| (17) | —$NCH_2COOH$<br>\|<br>$CH_2$— | —COOH |
| (18) | — | —COOH |
| (19) | —$CH_2$— | —$SO_3Na$ |
| (20) | —$CH_2$— | —$SO_2NHCH_3$ |
| (21) | —$CH_2CH_2$— | —$CONHCH_3$ |
| (22) | —$CH_2CH_2$— | —OH |

These compounds are known and, for example, Japanese Patent Kokai (Laid-Open) Nos. 58-105231 and 59-9661 can be referred to for them.

Addition amount of these compounds represented by the formula [I], [II] and [III] is generally about 0.005--about 5 g, preferably about 0.01-about 2 g per 1 liter of developer.

The development processing solution of the present invention is preferably an aqueous alkali solution containing the following developing agent singly or in combination of two or more: usual developing agents for black-and-white photography such as hydroquinone, alkyl hydroquinones (e.g., t-butylhydroquinone, methylhydroquinone, and dimethylhydroquinone), catechol, pyrazole, chlorohydroquinone, dichlorohydroquinone, alkoxyhydroquinones (e.g., methoxy or ethoxy-hydroquinone), aminophenol developing agents (e.g., N-methyl-p-aminophenol and 2,4-diaminophenol), ascorbic acid developing agents, N-methyl-p-aminophenol sulfate, pyrazolones (e.g., 4-aminopyrazolone), 3-pyrazolidone developing agents (e.g., 1-phenyl-3-pyrazolidone, 1-phenyl-4, 4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tolyl-3-pyrazolidone, 1-phenyl-2-acetyl-4, 4-dimethyl-3-pyrazolidone, 1-p-hydroxyphenyl-4, 4-dimethyl-3-pyrazolidone, 1-(2-benzothiazolyl)-3-pyrazolidone, and 3-acetoxy-1-phenyl-3-pyrazolidone).

Especially, combination of hydroquinone with 3-pyrazolidones or hydroquinone with aminophenols is useful for rapid processing at high temperature.

The processing solution may be developer of so-called activator type which contains substantially no developing agent.

The developer containing at least one of the compounds represented by the formulas [I], [II] and [III] especially conspicuously exhibits the sludge inhibiting effect when it contains a large amount of sulfite ion. Specifically, content of sulfite ion in this case is at least 0.1 mol, preferably 0.2-1.0 mol per 1 liter of the developer. As sulfites which provide sulfite ion, there may be used sulfites of alkali metals such as sodium sulfite, potassium sulfite, and potassium metabisulfite.

Silver sludge produced in the developer is apt to be deposited especially on roller or belt in processor and the silver sludge deposited on roller or belt tends to stain light-sensitive materials. Therefore, the present invention can be especially effectively applied to processing by automatic processor.

Such automatic processors include, for example, those of opposed roller type (for example, Pakorol Super G24-2 of PAKO Co., G-14L, FG-24SQ, and RN of Fuji Photo Film Co., Ltd.), those of staggered roller type (for example, Kodalith Processor and M6 Processor of Eastman Kodak Co. and RU of Fuji Photo Film Co., Ltd.), those of belt conveyor type (for example, LD-241D of Log-E-tronics Co.) and Cronalith of Dupont.

If necessary, the developer may further contain buffers such as carbonates, boric acid, borates, and alkanolamines; alkali agents such as hydroxides and carbonates; dissolving aids such as polyethylene glycols and estes thereof; pH adjusters such as organic acids, for example, acetic acid; sensitizers such as quaternary ammonium salts; development accelerators; surface active agents; and hardeners.

The developer may further contain antifoggants, for example, benzotriazoles such as 5-nitroindazole, 5-nitrobenzimidazole, 5-methylbenzotriazole, and 5-nitrolbenzotriazole, tetrazoles and thiazoles such as benzothiazole and 1-phenyl-5-mercaptotetrazole and compounds mentioned in British Patent No. 1,269,268, chelating agents such as ethylenediaminetetraacetic acid, alkali metal salts thereof, polyphosphates, and nitriloacetic acid.

The pH value of the thus prepared developer is selected so as to give the desired density and contrast and is preferably about 8-12. Developing temperature and time correlate with each other and are determined in relation with total processing time. In general, developing time is 10 seconds-3 minutes at about 20°-30° C. and the temperature is about 30°-60° C. in case of rapid processing at high temperature.

In the present invention, the necessary components of the developer may be contained at the time of using the developer and the developer before preparation as liquid for use may be in any forms of mixture of solid components, concentrate, solution, emulsion, suspension and the like. For example, the developer may comprise components of same or different form which are divided to some portions or may be in the form of powdery or liquid preparation previously made from these components.

The preparation can be made into liquid to be used by dissolving it in water or diluting it with water.

Fixer is an aqueous solution containing a thiosulfate and a water-soluble aluminum compound and, preferably, has a pH of about 3.8–5.5 (20° C.). In the method of the present invention, a stopping step may be provided after development, but in general, stopping step is omitted in automatic processor of roller conveying type. Therefore, developer is carried into fixer to cause increase of pH of the fixer. Thus, it is desired to adjust pH of fixer to about 3.8–5.0 (20° C.).

Fixing agent is a thiosulfate such as ammonium thiosulfate or sodium thiosulfate and ammonium thiosulfate is especially preferred from the point of fixing speed. Amount of fixing agent can be optionally changed and is generally about 0.1–5 mol/1.

Water-soluble aluminum salt which acts mainly as a hardener in the fixer is a compound generally known as a hardener for acidic hardening fixer and includes, for example, aluminum chloride, aluminum sulfate and potash alum.

According to the method of the present invention, the developed and fixed photographic material is washed with water and dried. Washing with water is carried out to remove nearly completely the silver salt dissolved by fixing and is preferably carried out at about 5°–50° C. for 10 seconds - 3 minutes. Drying is carried out at about 30°–80° C. and drying time which may be optionally varied depending on ambient conditions can normally be about 5 seconds - 3.5 minutes.

Light-sensitive materials processed by the method of the present invention may be of any uses, but are preferably those for black-and-white photography, namely, X-ray sensitive materials, sensitive materials for microfilm, sensitive materials for unlith, materials for photocomposition, sensitive materials for black-and-white photography for amateurs, and the like. Silver halide of light-sensitive layer is silver chloride, silver chlorobromide, silver chloroiodobromide, silver bromide, silver iodobromide, or the like. Furthermore, light-sensitive materials used in the present invention may be either negative type or direct positive type.

Silver halide photographic light-sensitive material to which the method of the present invention can be applied comprises a support and, provided thereon, at least one silver halide emulsion layer. The silver halide emulsion layer may be provided not only on one side of the support, but also on both sides of the support. Of course, if necessary, it may have backing layer, antihalation layer, intermediate layer, uppermost layer (e.g., protective layer) and the like.

The silver halide emulsion is a dispersion of a silver halide in a hydrophilic colloid such as gelatin, modified gelatin, colloidal albumin, casein, carboxymethyl cellulose, hydroxyethyl cellulose, sodium alginate, polyvinyl alcohol, polyvinylpyrrolidone, or a mixture thereof. The silver halide emulsion is prepared by mixing a water-soluble silver salt (e.g., silver nitrate) and a water-soluble halide in the presence of water and hydropholic colloid by methods well known to one skilled in the art such as single jet method, double jet method, and controlled jet method, followed by physical ripening and chemical ripening such as gold sensitization and/or sulfur sensitization. During preparation or just before coating of silver halide emulsion, there may be added spectral sensitizers such as cyanine dye, merocyanine dye, and mixtures thereof; stabilizers such as 4-hydroxy-6-methyl-1,3,3a,7-tetrazaindene; sensitizers such as compounds mentioned in U.S. Pat. No. 3,619,198; antifoggants such as benzotriazole, 5-nitrobenzimidazole, and polyethylene oxide; hardeners such as formalin, glyoxal, mucochloric acid, and 2-hydroxy-4,6-dichloro-s-triazine: coating aids such as saponin, sodium lauryl sulfate, dodecylphenol polyethylene oxide ether, and hexadecyltrimethylammonium bromide: and the like. The thus obtained silver halide emulsion is coated on a support such as baryta paper, resin-coated paper, collulose acetate film, or polyethylene terephthalate film by dipping method, air knife coating method, bead coating method, extrusion doctor coating method, double-side coating method or the like and the coat is dried.

The present invention will be explained in detail by the following nonlimiting examples.

EXAMPLE 1

The following developers (A)–(K) were prepared. They all had a pH of 10.65.

| | | |
|---|---|---|
| Developer (A): | Sodium sulfite | 67 g |
| | Hydroquinone | 23 g |
| | 1-Phenyl-3-pyrazolidone | 0.4 |
| | Potassium hydroxide | 11 g |
| | Sodium carbonate (monohydrate) | 11 g |
| | potassium bromide | 3.0 g |
| | Water to make up 1 liter. | |
| | pH | 10.65 |
| Developer (B): | This was prepared by adding 500 mg of compound (1) examplified hereabove to developer (A). | |
| Developer (C): | This was prepared by adding 500 mg of compound (2) to developer (A). | |
| Developer (D): | This was prepared by adding 500 mg of compound (6) to developer (A). | |
| Developer (E): | This was prepared by adding 500 mg of a compound of the formula [I] where M is is hydrogen, A is SH and B is $NHC_6H_5$ as a comparative compound to developer (A). | |
| Developer (F): | This was prepared by adding 500 mg of a compound of the formula [I] where M is hydrogen, A is SH and B is $N(C_2H_5)_2$ as a comparative compound to developer (A). | |
| Developer (G): | This was prepared by adding 300 mg of compound (12) to developer (A). | |
| Developer (H): | This was prepared by adding 300 mg of compound (13) to developer (A). | |
| Developer (I): | This was prepared by adding 300 mg of compound (17) to developer (A). | |
| Developer (J): | This was prepared by adding 500 mg of a compound of the formula [II] where M is hydrogen and —A'—B' is $NHC_6H_5$ as a comparative compound to developer (A). | |
| Developer (K): | This was prepared by adding 500 mg of a compound of the formula [II] where M is hydrogen and —A'—B' is $N(C_6H_5)$ as a comparative compound to developer (A). | |

The following composition was used as a fixer.

| | |
|---|---|
| Ammonium thiosulfate | 200.0 g |
| Anhydrous sodium sulfite | 20.0 g |
| Boric acid | 8.0 g |
| Disodium ethylenediaminetetraacetate | 0.1 g |
| Aluminum sulfate | 15.0 g |
| Sulfuric acid | 2.0 g |

-continued

| | |
|---|---|
| Glacial acetic acid | 22.0 g |
| Water to make up 1 liter. | |
| (pH was adjusted to 4.2.) | |

Then, the thus obtained developers (A)-(K) were subjected to the following experiments Twenty-two liters of the developer was put in an automatic processor of roller conveyer type. A black-and-white photographic film (amount of silver 4.5 g/m$^2$) comprising polyethylene terephthalate film and silver chlorobromide (silver chloride 50 mol%) emulsion layer provided thereon which had been exposed imagewise was led into the above automatic processor to develop it. Developing temperature was 38° C and developing time was 20 seconds. Fresh developer was automatically replenished in an amount of 100 ml for development of every one of the photographic film of full size (20 inches × 24 inches).

One hundred sheets of the films of the above size were developed for 5 hours in one day and this procedure was conducted successively for one week. The developer [developer (A)] to which the compound of the present invention was not added and which was colorless and clear soon began to become turbid and showed deposition of silver sludge during development of the first 100 films.

Further, silver stain in the form of streaks began to occur on the films. This stain became heavier during development for one week. There occurred heavy tubidity and deposition of silver sludge in the developer and heavy silver stain also occurred on the roller of the automatic processor. The streak-like silver stain on the film became serious with increase of the number of the processed films.

Furthermore, damage which seemed to be caused due to contact with sludge sticking to the roller was seen on the surface of the films.

In the case of developers (E), (F), (J), and (K) which contained comparative compound, substantially no silver sludge was recognized even after development of one week, but development with the developer just after preparation resulted in more serious desensitization and reduction in contrast and maximum density than development with developer (A).

On the other hand, in the case of developers (B), (C), (D), (G), (H), and (I) which contained the compound of the present invention, no silver sludge was seen even after development of one week and they retained clearness. Besides, these developers gave good photographic characteristics which was by no means inferior to those obtained by developer (A).

EXAMPLE 2

The following developer (a) was prepared.

| Developer (a): | |
|---|---|
| Disodium ethylenediaminetetraacetate | 2 g |
| Hydroquinone | 24 g |
| Potassium sulfite | 100 g |
| Potassium bromide | 0.52 g |
| Sodium hydroxide | 14 g |
| Triethylene glycol | 4.3 g |
| 5-Nitroindazole | 0.1 g |
| 5-Methylbenzotriazole | 0.05 g |
| Potassium hydroxide | 3.5 g |
| Water to make up 1 liter | |

-continued

| Developer (a): | |
|---|---|
| pH | 11.5 |

Developers (b)-(k) were prepared by adding 300 mg of compounds (1)-(10) to developer (a), respectively.

Developers (l)-(w) were prepared by adding 200 mg of compounds (11)-(22) to developer (a), respectively.

These developers were tested in the same manner as in Example 1 except that black-and-white photographic film (amount of silver 3.5 g/m$^2$) comprising a polyethylene terephthalate film and silver chloride emulsion layer provided thereon was used. In the case of developer (a), much silver sludge was formed while in the case of developers (b)-(w), no silver sludge was formed and the resulting photographic characteristics showed no problems.

In the above Examples, all of the compounds added to the developers had —SH as substituent —SM.

According to the present invention, formation of silver sludge in a developer containing silver halide solvent such as sulfate can be inhibited without damaging photographic characteristics by using a mercapto compound represented by the formula (I), (II) or (III).

What is claimed is:

1. A developer for silver halide photographic light-sensitive material which contains at least one of the compounds represented by Formulas I, II and III as follows:

Formula I:

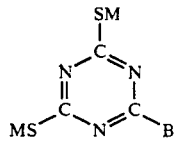

I wherein M represents a hydrogen atom, an alkali metal or $NH_4$, and B represents a hydroxyalkyl group, or

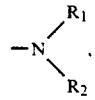

$R_1$ and $R_2$ each representing a hydrogen atom or —X—Y group in which X represents a divalent group and Y represents a carboxyl group or a hydroxyl group;

Formula II:

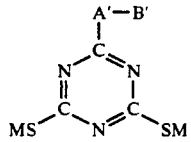

II wherein M represents a hydrogen atom, an alkali metal or $NH_4$, A' represents an organic divalent group, and B' represents $—SO_3M'$, —COOM', $—SO_2NHR_3$, $—CONHR_3$, or —OH wherein M' represents a hydrogen atom, an alkali metal atom or $NH_4$, and $R_3$ represents a hydrogen atom or an alkyl group of 1-3 carbon atoms; and Formula III:

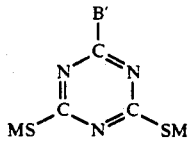

III wherein M and B′ are the same as defined in the above

Formula II;

wherein content of the compound is about 0.005 g--about 5 g per 1 liter of the developer;

and wherein said developer further contains an antifoggant selected from the group consisting of 5-nitroindazole, 5-nitrobenzimidazole, 5-methyl-benzotriazole, 5-nitrobenzotriazole, benzothiazole, and 1-phenyl-5-mercaptotetrazole.

2. A developer according to claim 1, wherein the content of the compound is about 0.01 g–about 2 g.

3. A developer according to claim 1 which is an alkaline aqueous solution containing at least one developing agent.

4. A developer according to claim 1 which is a developer of activator type containing no developing agent.

5. A developer according to claim 1 which contains at least 0.2 mol of sulfite ion per 1 liter of the developer.

6. A method of developing which comprises processing a silver halide photographic light-sensitive material with the developer of claim 1.

7. A method of developing according to claim 6, which is carried out using an automatic processor.

8. A method of preventing silver sludge buildup during the development of silver halide photographic material, wherein the photographic material is developed with a developer which contains at least one the compounds represented by the Formulas I, II and III as follows:

Formula I:

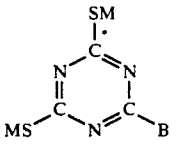

I wherein M represents a hydrogen atom, an alkali metal or $NH_4$, and represents a a hydroxyalkyl group, or

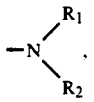

$R_1$ and $R_2$ each representing a hydrogen atom or —X—Y group in which X represents a divalent group and Y represents a carboxyl group or a hydroxyl group;

Formula II:

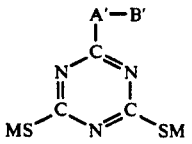

II wherein M represents a hydrogen atom, an alkali metal or $NH_4$, A′ represents an organic divalent group, and B′ represents $—SO_3M'$, —COOM′, $—SO_2NHR_3$, or —OH wherein M′ represents a hydrogen atom, an alkali metal atom or $NH_4$, and $R_3$ represents a hydrogen atom or an alkyl group of 1—3 carbon atoms; and Formula III:

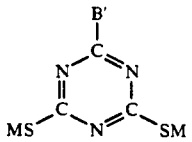

III wherein M and B′ are the same as defined in the above Formula II;

wherein content of the compound is about 0.005 g--about 5 g per 1 liter of the developer;

and wherein said developer further contains an antifoggant selected from the group consisting of 5nitroindazole, 5-nitrobenzimidazole, 5-methyl-benzotriazole, 5-nitrobenzotriazole, benzothiazole, and 1-phenyl-5-mercaptotetrazole.

* * * * *